United States Patent [19]

Bell

[11] Patent Number: 5,009,850

[45] Date of Patent: Apr. 23, 1991

[54] BLOOD CONTAINMENT DEVICE

[75] Inventor: Craig J. Bell, Winchester, N.H.

[73] Assignee: Smiths Industries Medical Systems, Inc., Keene, N.H.

[21] Appl. No.: 518,311

[22] Filed: May 4, 1990

Related U.S. Application Data

[63] Continuation of Ser. No. 190,498, May 5, 1988, abandoned.

[51] Int. Cl.[5] ..... B01L 11/00

[52] U.S. Cl. ..... 422/99; 422/56; 422/58; 422/61; 422/66; 422/102; 436/166; 436/169; 435/311; 435/810

[58] Field of Search ..... 422/56, 58, 61, 66, 422/99, 102; 436/8, 16, 18, 44, 63, 80, 165, 166, 169, 176, 170; 435/292, 293, 311, 810

[56] References Cited

U.S. PATENT DOCUMENTS

| | | | |
|---|---|---|---|
| 2,585,938 | 2/1952 | Jordan . | |
| 2,644,452 | 7/1953 | Brown . | |
| 3,216,804 | 11/1965 | Natelson | 422/66 X |
| 3,554,005 | 1/1971 | Koblin et al. | 422/66 X |
| 3,675,488 | 7/1972 | Viktora et al. | 422/66 X |
| 3,876,067 | 4/1975 | Schwarz . | |
| 3,904,369 | 9/1975 | Adler et al. | 422/66 X |
| 4,071,315 | 1/1978 | Chateau | 422/66 X |
| 4,218,421 | 8/1980 | Mack, Jr. et al. | 422/102 X |
| 4,259,383 | 3/1981 | Eggensperger et al. | 422/28 X |
| 4,351,434 | 9/1982 | Elisha . | |
| 4,375,849 | 3/1983 | Hanifl . | |
| 4,418,821 | 12/1983 | Sandel . | |
| 4,421,719 | 12/1983 | Burleigh | 422/66 X |
| 4,485,918 | 12/1984 | Mayer . | |
| 4,576,281 | 3/1986 | Kirksey . | |

*Primary Examiner*—Robert J. Warden
*Assistant Examiner*—Lynn M. Kummert
*Attorney, Agent, or Firm*—Sewall P. Bronstein; Robert M. Asher

[57] ABSTRACT

A blood containment device including a housing with an opening through which absorbent material is exposed. Blood is expelled from a syringe onto the exposed material. The housing has two chambers, one for the clean material and one containing a take-up reel onto which the blood stained material is wound.

6 Claims, 1 Drawing Sheet

BLOOD CONTAINMENT DEVICE'

This is a continuation of co-pending application Ser. No. 07/190,498 filed on May 5, 1988, now abandoned.

BACKGROUND OF THE INVENTION

The present invention relates to a device and method for providing safe inspection and containment of blood expelled from a syringe.

In the procedure of blood gas analysis, there are several times when medical and laboratory personnel are exposed to blood. This blood is considered a biohazard because of its potential to contaminate hospital personnel with disease (hepatitis, AIDS, etc.).

In doing blood gas analysis in a laboratory, a common procedure called "topping off the sample" is performed with little regard to its hazardous implications. The phrase "topping off the sample" refers to the method of expelling blood from the blood gas sampling syringe onto a gauze. This is usually done just prior to injecting or aspirating blood to the blood gas machine or other analysis machines (co-oximitry, electrolytes, hematocrit, etc.). The reasons for doing this are to ensure that the analysis is run on blood from the body of the sample (less likely to be contaminated by ambient air) and to allow the lab technician to visually check for clots. A sample with clots is usually not run because the gas values are changing and clots can occlude the blood gas machine, resulting in machine down time.

There are several opportunities for hazardous exposure to blood when using the conventional method for "topping off the sample." First, there is a possibility of exposure during the open handling of the gauze and expelling of blood onto the gauze. Second, there is the possibility of contamination of the surface or table on which the gauze is placed. Third, the disposal of the gauze, usually into an open container, leaves a further danger of exposure.

The object of the present invention is to provide a safe and cost effective means for expelling blood from a syringe.

SUMMARY OF THE INVENTION

The present invention is directed to a blood containment device formed by a housing which contains a roll of absorbent material. The housing contains an opening which exposes a portion of the absorbent material. A take-up reel is provided for winding up the used material past the opening.

The device is used by expelling blood from a syringe onto the material exposed through the opening in the housing. After inspecting the blood to determine if there are clots, the take-up reel is turned to pull the blood stained gauze past the opening. Thus, the blood is quickly and easily removed from potential contact with laboratory personnel.

Other objects and advantages of the present invention will become apparent from the following description taken in conjunction with the drawings.

DETAILED DESCRIPTION OF THE PREFERRED EMBODIMENT

Figure 1:
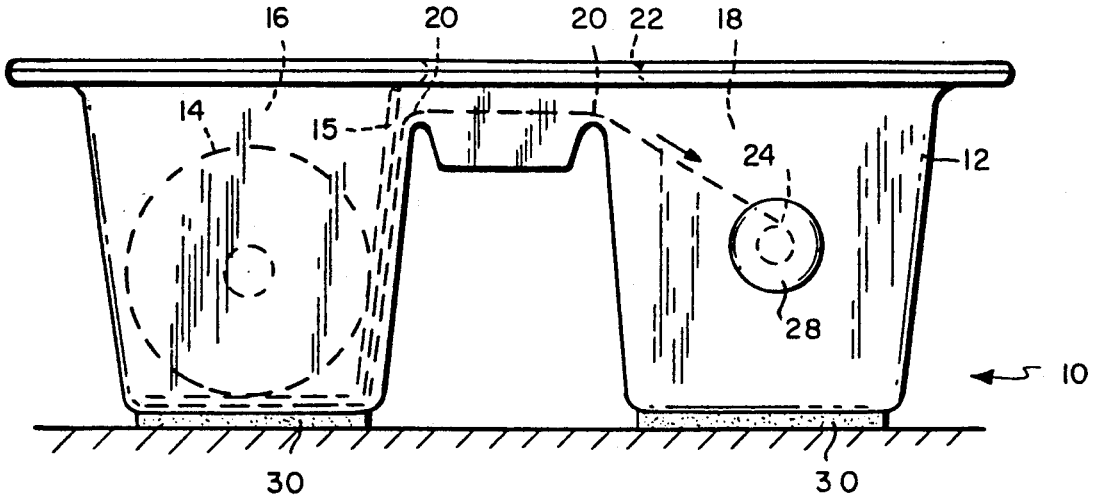
FIG. 1 is an elevational view in partial cross section of the blood containment device of the present invention.

Referring now to the drawings, a blood containment device 10 is shown. The device 10 includes a housing 12 which may be formed from a material such as polypropylene. The housing 12 may be made in two parts. The bottom may be vacuum formed and later a top may be attached to it to form an enclosure.

Figure 2:
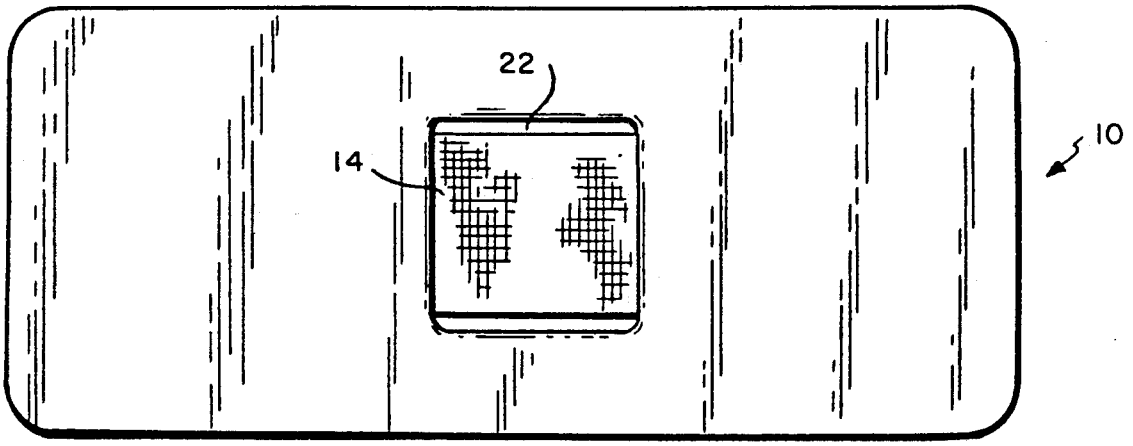
FIG. 2 is a plan view of the blood inspection device of FIG. 1.

Inside the housing 12, a roll of absorbent material 14, such as gauze or non-woven, is included. The absorbent material may be impregnated with an antimicrobial agent, such as silver sulfadiazine, to immobilize active contaminates. The housing 12 is divided into two chambers. A first chamber 16 holds the clean absorbent material 14 and a second chamber 18 holds the blood stained material. In between the two chambers, the housing is formed with two ledges 20 which support the absorbent material proximate to an opening 22 in the top of the housing 12. A tension member 15, non-integral with the housing 12, keeps the absorbent material taut across the ledges 20. The tension member 15 is simply a converted piece of cardboard which routes the absorbent material in a manner to act as a tension drag. As shown in FIG. 2, the absorbent material 14 is exposed through the opening 22.

Figure 3:
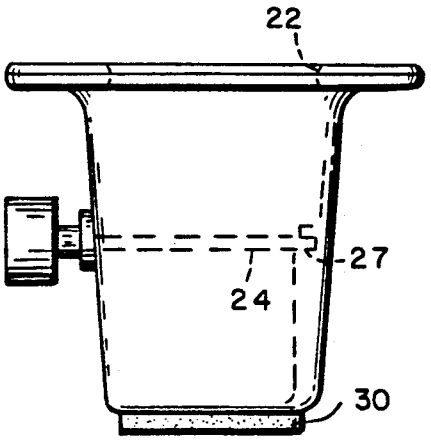
FIG. 3 is a side view of the blood inspection device of FIG. 1.

The chamber 18 for receiving the bloodstained material 14 includes a take-up reel 24. One end of the absorbent material 14 is secured to the take-up reel 24. As shown in FIG. 3, the take-up reel 24 has a handle 28 for turning the reel and a sealing grommet 26 for holding it in place. At the end of the reel 24 inside the chamber 18, the reel is snapped into and supported by a yoke 27 formed in the chamber.

The device 10 may be provided with a pressure sensitive adhesive foam liner 30 on its bottom. This will permit the device to be stuck onto a table during use and prevent accidental spilling of the device. The adhesive should be such so as to permit the device to be lifted from the table and discarded after the roll of absorbent material has been used up.

In using the blood containment device 10, blood is expelled from a syringe onto the absorbent material 14 exposed through the opening 22. The blood may then be visually inspected to determine whether there is any clotting. After the inspection is done, the handle 28 is turned to wind the absorbent material past the opening 22 and onto the take-up reel 24. When the roll of absorbent material is close to the end, an indicating line will appear in the opening, to inform the user that the material is almost used up. When the absorbent material is totally used up, the opening can be closed by using an adhesive label or snap-on lid. The blood containment device, thus, advantageously minimizes the risks of contact with the expelled blood.

Of course it should be understood that various changes and modifications to the prefered embodiment described above will be apparent to those skilled in the art. For example, many geometries may be selected for the housing which would be equally suitable for carrying out the invention. This and other changes can be made without departing from the spirit and the scope of the invention and without diminishing its attendant advantages. It is therefore intended that such changes and modifications be covered by the following claims.

I claim:

1. A blood containment device comprising:

a housing having means defining an opening;

a roll of absorbent material stored within said housing;

a tension plate, non-integral with said housing, located within said housing to help maintain said absorbent material taut beneath said opening; and a take-up reel arranged within said housing so that said reel may be used to pull said absorbent material past the opening in said housing as said material is rolled onto said reel.

2. The blood containment device of claim 1 further comprising a handle external to said housing and connected to said take-up reel to permit winding of said take-up reel to pull said absorbent material past the opening in said housing.

3. The blood containment device of claim 1 further comprising an antimicrobial agent impregnated in said absorbent material.

4. The blood containment device of claim 1 wherein said housing contains two chambers, one for said roll of absorbent material and one for said take-up reel onto which said absorbent material is rolled and wherein said tension plate is situated within the chamber containing said roll of absorbent material.

5. The blood containment device of claim 1 further comprising a pressure sensitive adhesive foam on the side of said housing opposite to the opening for securing said device to a surface.

6. The blood containment device of claim 1 wherein the absorbent material comprises absorbent non-woven material.

* * * * *